United States Patent [19]

Merat et al.

[11] 4,189,899

[45] Feb. 26, 1980

[54] APPARATUS FOR DE-AERATING AND VACUUMING PACKING WITH TIGHT CLOSING ANTI-POLLUTION DEVICE

[76] Inventors: Jean-Pierre Merat, 135 Avenue Gabriel Peri, Le Perreux; Gaston Wiel, 60 Bd. Emile Augier, Paris, both of France

[21] Appl. No.: 873,439

[22] Filed: Mar. 15, 1978

[30] Foreign Application Priority Data

Jan. 6, 1978 [FR] France ..... 78 00283

[51] Int. Cl.[2] ..... B65B 43/26

[52] U.S. Cl. ..... 53/570; 53/512; 141/314

[58] Field of Search ..... 53/570, 384, 512; 141/166, 314, 315

[56] References Cited

U.S. PATENT DOCUMENTS

| | | | |
|---|---|---|---|
| 3,150,472 | 9/1964 | Moore | 53/512 X |
| 3,851,444 | 12/1974 | Merat | 53/570 X |

*Primary Examiner*—Travis S. McGehee
*Attorney, Agent, or Firm*—Barry Kramer

[57] ABSTRACT

A de-aeration and vacuum packaging apparatus includes porous closeable disks and a tight closing, anti-pollution filler device. The apparatus is suitable for use with a machine adapted for filling packages with a freely flowing material which includes bag supporting means comprising a clamping part formed intergral with a horizontal support which is equipped at each end with slides serving as a guide for sliding supports, each slide including side sections fitted with grips linked together by hinges or by a flexible belt. Portions of the apparatus subjacent to the vertical hinges, along with a flexible spout are distortable in the lower part thereof through hinged plates connected to the vertical hinges. Reciprocating means connected to opposite sides of the hinged portions provide lateral pressure to conform the hinged portions to the distortable part of the spout in order to prevent escape of pollutive materials during the filling process.

9 Claims, 7 Drawing Figures

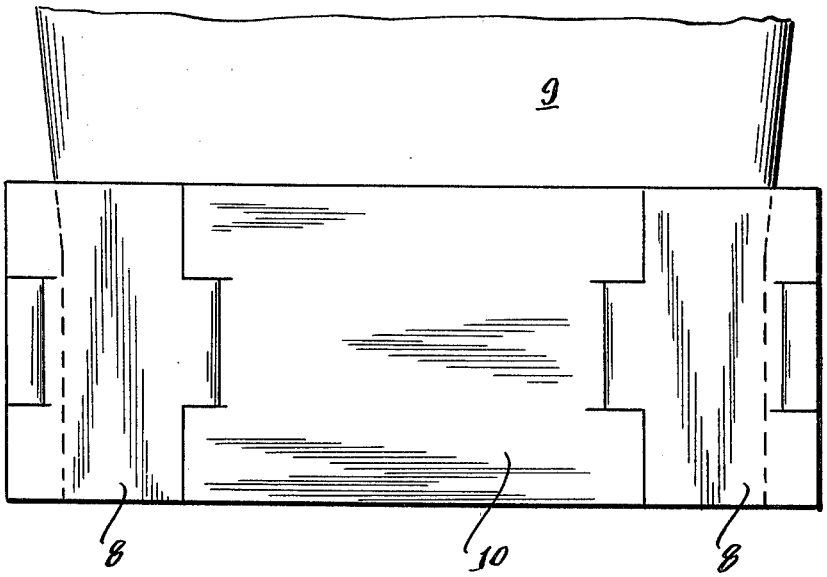
Fig. 3.
Fig. 4.
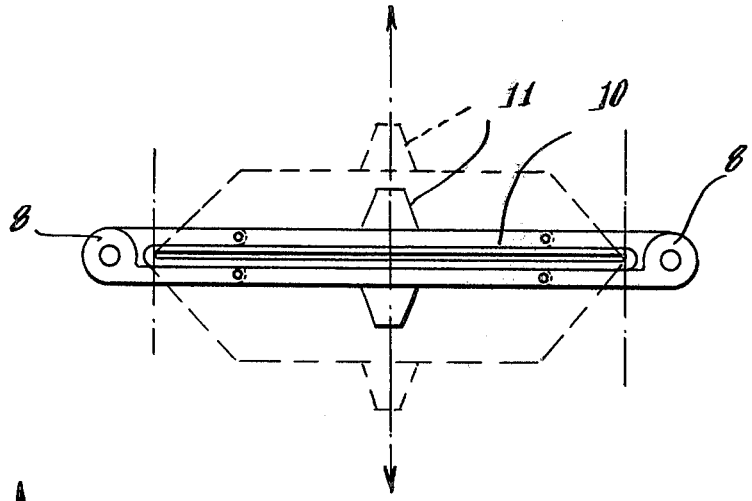
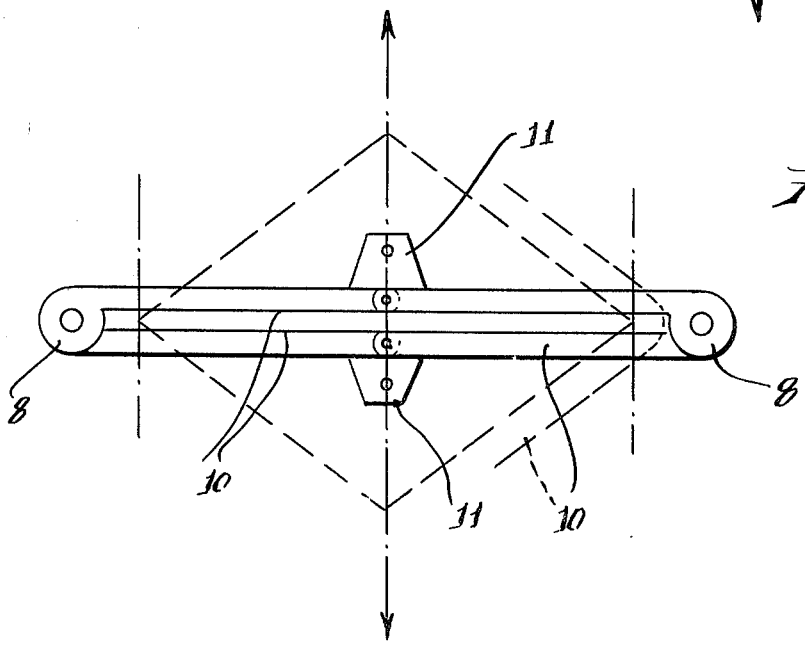
Fig. 5.

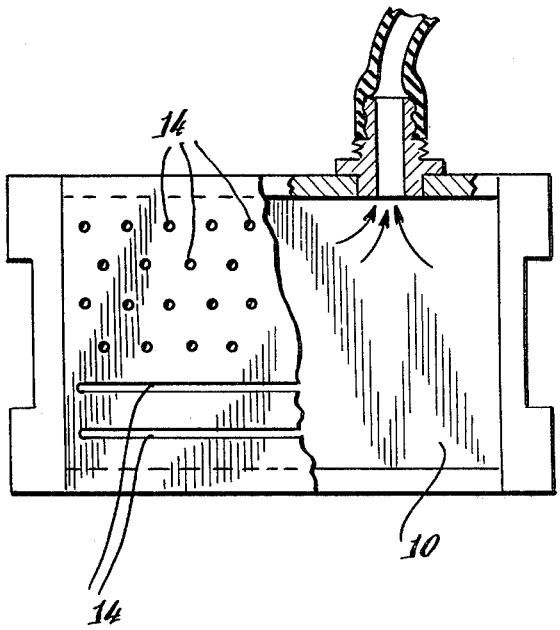
Fig. 6.
Fig. 7.
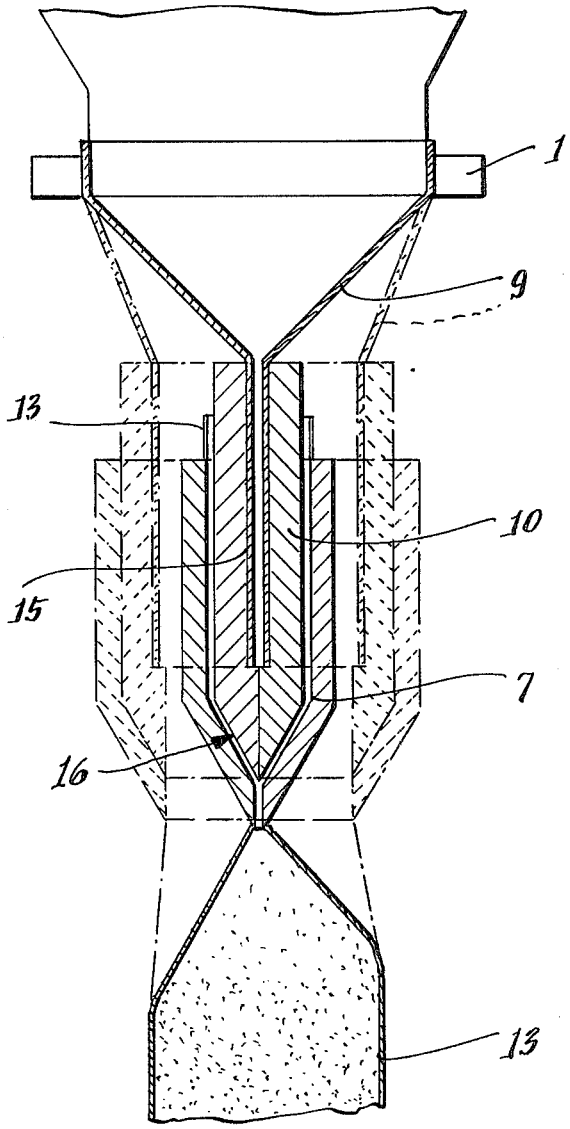

APPARATUS FOR DE-AERATING AND VACUUMING PACKING WITH TIGHT CLOSING ANTI-POLLUTION DEVICE

TECHNICAL FIELD

The present invention generally relates to the field of filling and packaging of flowable materials into various types of packages, either rigid, semi-rigid or flexible, and including boxes, bottles, drums, metal or synthetic material containers as well as paper, cardboard paper or other types of bags made from synthetic material. More particularly, the invention deals with apparatus for performing the filling and packaging operation which also functions to de-aerate and/or vacuum pack the material into the package or bag in a manner which eliminates escape of harmful or potentially pollutive materials.

BACKGROUND AND BRIEF DESCRIPTION OF THE INVENTION

In the past, apparatus employed for de-aeration or vacuum packing of flowable materials, particularly of a dusty composition, employed rarefaction or suction processes and included structure which was fitted peripherally around an opening in a bag or the like to filled which was then clamped to the filler spout of a filling machine. Many of these prior art devices were either incompatible with the particular materials being packaged for one reason or another, or did not completely de-aerate the materials being packaged, and seldom achieved true vacuum packing of the materials.

Typical apparatus previously employed for vacuum packing flowable materials into an open mouth type bag include a filling station provided with weighing or proportioning mechanism for measuring the amount of material being dispensed into the bag; a dispensing hopper provided with a cylindrical or oval spout about which an operator fits the mouth of an empty bag; and, a system of grips which secure the periphery of the bag defining the opening therein to the filling spout. These prior art devices are satisfactory for holding the bag in a proper position around the spout during filling but are undesirable from the standpoint that potentially harmful, pollutive materials are allowed to escape from the bag during, or shortly after, the filling process, due to incomplete sealing of the bag around the filler spout.

The filling operations which involve a flowable material that is particularly dusty in nature poses an even greater problem to be overcome, since, during high speed operations, a considerable amount of dusty material tends to be forced out of the bag opening which finds its way between the bag and the dispensing spout, thereby making it difficult to hermetically seal the bag around the spout in a manner to prevent emanation of the dusty materials into the ambient atmosphere. Moreover, prior art devices of the type described above are often provided with a dispensing spout which is exposed to the open air when a filled bag is removed therefrom, thus permitting a certain amount of dusty material remaining within the spout to escape into the atmosphere while a portion of such material which clings to the sides of the spout drop off when the bag is removed.

The present invention eliminates each of the above mentioned deficiencies inherent in prior art apparatus. According to the present invention, apparatus is provided for securing the bag on a filler spout in a manner to preclude escape of dusty materials from either the bag or the spout both during and after the filling operation in order to eliminate escape of filler materials into the atmosphere which may have deleterious effects either on the environment or human operators. The apparatus is particularly adapted for use with bags or packages provided with porous disks or openings in the sides thereof which may be coupled with an air suction system forming part of the apparatus which draws out dusty materials suspended in the air within the bag during the filling process. Subsequent to the filling process, the porous disks may be sealed by means of varnish, glue or an adhesive label applied thereto. The apparatus includes a spout provided with a lower flexible portion and a pair of opposed, shiftable hinged plates on opposite sides of the spout which have the opposite extremeties thereof connected to each other by hinges which allow shifting the plates toward and away from each other in a manner to selectively destort the spout in order to control the flow of material therethrough. A bag or the like is sleeved around the hinged plates while shiftable structure is provided including grip members for holding and tightly sealing the bag to the hinged plates.

BRIEF DESCRIPTION OF THE DRAWINGS

In the drawings, which form an integral part of the specification and are to be read in conjunction therewith, and in which like reference numerals are employed to represent like parts in the various views:

FIG. 3 is a side elevational view of linking hinged plates and the lateral hinges associated with the device of FIG. 2;

FIG. 4 is a bottom plan view of the positioning of the lower part of one form of the distortable spout suitable for use with the device of FIG. 2;

FIG. 5 is a bottom plan view of the positioning of the lower part of another form of the distortable spout;

FIG. 6 is a side view of the recessed hinged plate fitted with suction ports or grooves, parts being broken away for clarity; and, FIG. 7 is a cross-sectional view of the device of FIG. 2 showing the constructional details of the plates and the hinges.

DETAILED DESCRIPTION OF THE INVENTION

Figure 1:
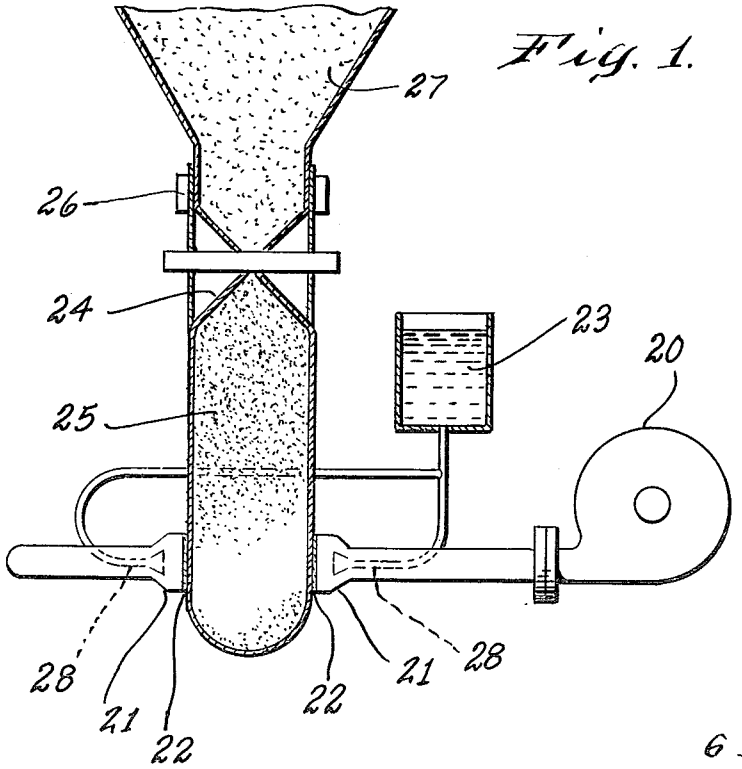
FIG. 1 is a side elevational view of a system employing the device of the present invention for packaging flowable materials into a flexible or semi-rigid bag or package, parts being broken away in section for clarity.

The present invention is generally concerned with a device and process suitable for use in de-aerating or vacuum packing materials which are delivered to a bag for the like, using apparatus similar to that shown in FIG. 1. In FIG. 1, one form of a device using the de-aeration and/or vacuum process consists of a suction device such as a vacuum pump 20 connected via suction disks 21 to porous disks 22 and possibly by means 28 for tightly closing the pores of the disks 22. In the form of the process and device referred to above, the disk tight closing means 28 may consist of diffusers connected with a varnish, glue or similar source 23. A heating system may also be provided to melt the external surface of the disks 23 in order to close the pores.

In using the apparatus shown in FIG. 1, a bag 24 to be filled with dusty, flowable materials 25, is secured to the mouth 26 of a bag filling machine 27. The bag 24 is provided with porous disks 22 in lower sidewalls thereof, against which are applied suction disks 21 thereby linking the vacuum pump 20 to the interior of the bag 24. During the filling process when dusty materials 25 enter the bag 24, vacuum pump 20 is energized to suck or draw out the air mixed with the dusty materials from the bag 24 via the disks 22 which tends to act as filters whereby to separate and remove the dusty materials from the air which is drawn out of the bag. Sufficient suction may be produced by the vacuum pump 20 to produce a partial vacuum within the bag 24, thereby producing vacuum packing of the material 25 within the bag 24. Upon completion of the filling process, the disks 22 are hermetically sealed by spraying, via diffusers 28, a varnish, glue or the like thereto. Alternately,the disks 22 may be provided with a meltable surface which seals upon the application of heat thereto in order to permit heat sealing of the pores in the disks 22. Also, a label or the like may be adhesively applied to the disks 22 in order to seal the latter. The geometry and construction the disks 22 will vary in accordance with the properties of the materials to be packaged and with the nature of the material from which the bag or package is constructed. Disks 22 may, for example, be formed from sintered metal, polyvinyl chloride, copolymers, vinylacetate, high density polyethylene, paper or various other kinds of materials.

Likewise, the number, shape, position, and dimensions of the disks 22 will be determined by the physical characteristics of the materials to be packaged as well as the speed with which the process is to be carried out.

Figure 2:
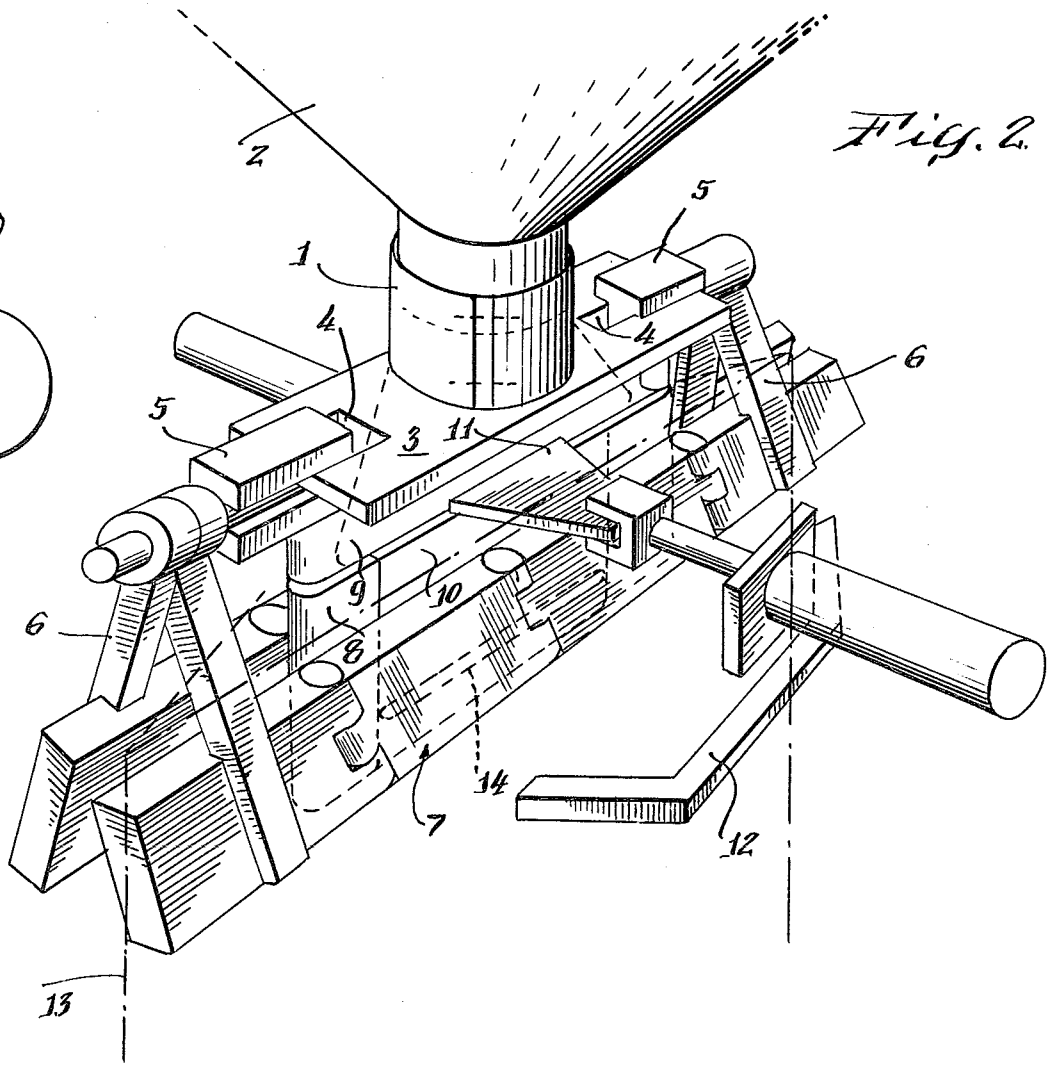
FIG. 2 is a perspective view of the device of the present invention shown in operative relation to a hopper adapted to contain a flowable material, in the absence of a bag or package to be filled.

Turning attention now to FIGS. 2 and 3, the tight closing, anti-pollution device for filling a bag with flowable material includes a clamping part 1 secured to the spout 2 of the intake hopper of a weigher or proportioner mechanism. The claimping part 1 is integral with the horizontal support 3 which is equipped at each end thereof with slides 4 serving as a guide for sliding supports 5, the opposite extremeties of sliding supports 5 being fitted with grips 6 connected together by hinges 7, or alternatively by a flexible belt (not shown) in their section subjacent of vertical hinges 8.

Clamping part 1 is also formed integral with a flexible spout 9 distortable in the lower part thereof via hinged plates 10 which are linked to vertical hinges 8. Spout 9 is further distortable by means of lateral pull or pressure 11 and conformation means 12.

At each end of the horizontal support 3, slides 4 are provided which allow sliding of supports 5 simultaneously with sliding of grips 6 and vertical hinges 8 secured to the supports.

As shown in FIGS. 2 through 5, the internal portion of the clamping part 1 which is secured to spout 2 of the intake hopper of the weigher or proportioner mechanism, is formed integral with the spout 9 and may comprise a flexible, impermeable tubing material, such as rubber, fabric, woven or un-woven plastic which is held flat in its lower part by hinged plates 10 which are arranged in a manner to impart a pressure or traction force on the opposite faces of the tubing, the opening or closing of the tubing being produced by geometrical distortion thereof.

A sack or bag is held on spout 9 by two sets of grips 6 secured to the sliding supports 5 which are connected together by hinges 7 or by the flexible belt mentioned above. The sliding supports contain, in the subjacent section thereof, vertical hinges 8 which are linked to hinged plates 10 and are secured to the lower part of the distortable spout 9, so that the assembly of the grip 6, hinges 8 and plates 10 exactly follow the concentric and eccentric movements of the lower part of the spout 9 when it opens or closes.

A pair of alternate versions of portions of the device are depicted in FIGS. 4 and 5 which are provided with varying numbers of the hinged plates 10 in order to produce openings having numerous types of configurations in accordance with the shape of the spout and the type of package or bag being filled.

As shown in FIG. 6, the lower part of the spout 9 may be equipped with recessed hinged plates, provided with suction ports 14 therethrough and connected to a vacuum pump (not shown). The spout 9 is further connected to means of lateral pull or pressure 11 which actuate the vacuum pump when the circumference of the bag 13 is installed around the opening of the spout 9 thereby providing an effective means of holding and keeping the bag 13 perfectly tight during the filling thereof.

The push or pull means 11, which are fitted on opposite sides of the support axis 3, provide opening and closing of the lower part of the spout 9 by applying traction or tension on the spout opening in order to open the same and provide uniform lateral pressure on the spout in order to close the same. Push or pull means 11 may consist of drive actuators or various other mechanism as will be recognized by those skilled in the art.

Although not specifically shown in the drawings, spout 9 can be opened or closed by various types of actuators which apply the necessary reciprocating forces to the axial part of the support of grips 6. Also, as shown in FIG. 7, in order to avoid any possibility of the escape of material from the bag, the hinged plates 10 of spout 9 are constructed in a manner to provide an internal recess 15 designed to house the lower part of the flexible tube forming spout 9 together with an external tapering 16 of their lower end, so that in their closed position, the plates 10 join up below spout 9 providing essentially perfect tightness.

As shown in FIG. 2, in order to ensure additional reliability in the sealing of spout 9 during the filling of the bag 13, the means of lateral pull may include one or more conforming elements on the ends thereof of a geometry compatible with that of spout 9 on which bag 13 air locks during filling, the conforming elements 12 matingly engaging the spout 9 in a manner to preclude escape of material from the spout 9 or the bag 13.

Turning now to a description of the operation of the device, and referring now more particularly to FIG. 2, the present device is secured via clamping part 1 on spout 2 of the intake hopper of a weigher or proportioner mechanism. With the device in its non-operative open position, grips 6 are open and spaced from each other, and spout 9 is closed. An empty sack 13 is manually or automatically fitted around the spout 9 and is held thereagainst by intake ports 14 connected by means of flexible pipes or the like to a suction device such as vacuum pump (not shown). A sensor or contactor (not shown) appropriately mounted on the device adjacent the spout 9 detects the presence of bag 13 around the spout 9 and energizes electrical or pneumatic actuating means (not shown) for closing the grips 6 thereby securing the empty bag 13 to the lower part of spout 9 by the clamping effect of clamps 6, hinges 7 (or alternatively, a flexible belt) and hinged plates 10.

A second sensor or contactor (not shown) mounted on the device is activated by the closing of grips 6. Upon actuation of the second sensor, spout 9 is opened through traction or lateral movement of the push or pull means 11 which hold the bag, in combination with the conforming means 12, captive around the spout 9, spout 9 being held stationary on either side thereof by grips 6, hinges 7 and hinged plates 10. When the bag 13 is filled to the desired level, an automatic or manual signal produced by a weighing or proportioner system activates push or pull means 11 to close spout 9 thereby hermetically blanking off spout 9 while holding the mouth of the bag flat on either side of the spout by means of grips 6. A squeezing and removing device (not shown) then operates on the sides of the bag to settle the material therewithin after which grips 6 are opened and the filled bag is removed from the device, thereby readying the latter for another filling cycle.

From the foregoing, it can be appreciated that the present invention provides a bag filling apparatus which not only provides for the reliable accompishment of the objects of the invention, but does so in a particularly safe and efficient manner. It is recognized, of course, that those skilled in the art may make various modifications or additions to the preferred embodiment chosen to illustrate the invention without departing from the gist and essence of the present contribution to the art. Accordingly, it is to be understood that the protection sought and to be afforded hereby should be deemed to extend to the subject matter claimed and all equivalents thereof fairly within the scope of the invention.

We claim:

1. Apparatus for filling a bag with a flowable material including:

a spout including a flexible portion adapted to be coupled with a source of said material;

a pair of opposed, shiftable hinge plates respectively abutting opposite sides of said spout and having the opposite extremeties thereof connected with each other by hinges to allow shifting of said plates toward and away from each other whereby to distort said flexible spout portion and control the flow of said material through said spout portion, said hinge plates being adapted to have said bag sleeved therearound;

means operably coupled with said hinge plates for selectively shifting the latter toward and away from each other;

a horizontal support disposed above said hinge plates;

a pair of slide members respectively mounted for sliding movement on opposite extremeties of said horizontal support;

a pair of sliding supports respectively mounted on said slide members for sliding movement along with the latter;

a pair of grip members extending downwardly from said sliding supports and shiftably mounted on each of the latter for shifting movement toward and away from each other; and flexible structure connected to corresponding ones of said grip members and extending between the latter on opposite sides of said hinge plates, said flexible structure being shiftable into engagement with said bag upon shifting of said grip members toward each other whereby to releasably hold said bag against said hinge plates.

2. The apparatus of claim 1, wherein said hinge plates each include perforated portions therein placing parts of said bag in communication with the space between said hinge plates, and there is further provided means coupled with said space for reducing the pressure within the latter whereby to produce suction in said perforated portions for holding said bag against said hinge plates.

3. The apparatus of claim 1, wherein there is further provided:

a clamping part comprising a sleeve member adapted to circumscribe upper portions of said spout and secured to the latter for mounting said apparatus on said spout;

said clamping part being secured to said horizontal support, said horizontal support including a bore therein adapted to receive said spout therethrough.

4. The apparatus of claim 1, wherein each of said hinge plates includes a recessed area in the face thereof opposing the opposite hinge place for receiving at least parts of said flexible portion of said spout therein.

5. The apparatus of claim 1, wherein said grip members each comprise an arm having one end thereof pivotally mounted on the respectively associated sliding support and said hinge structure is mounted on the opposite end of said arm.

6. The apparatus of claim 1, wherein said flexible structure comprises a plurality of holding elements pivotally interconnected by hinges, each of said holding elements including surface portions conforming in contour to the opposing portions of the adjacent hinge plate.

7. The apparatus of claim 1, wherein said flexible structure comprises a belt member.

8. The apparatus of claim 1, wherein each of said hinge plates comprises first, second and third plate portions, said second plate portions being interposed between said first and third plate portions and connected to each of the latter by hinges pivotable about essentially vertical axes.

9. The apparatus of claim 1, further including conformation means disposed on opposite sides of said hinge plates and shiftable toward each other into adjacency with said hinge plates whereby to engage lower portions of said bag for conforming the latter to the contour of said hinge plates.

* * * * *

UNITED STATES PATENT AND TRADEMARK OFFICE

CERTIFICATE OF CORRECTION

PATENT NO. : 4,189,899

DATED February 26, 1980

INVENTOR(S) : Jean-Pierre Merat, Gaston Wiel

It is certified that error appears in the above-identified patent and that said Letters Patent are hereby corrected as shown below:

In the Foreign Application Priority Data, the serial number of the French application identified as "7800283" should read -- 7800273 --.

In claim 4, line 35: delete "place" and insert therefor --plate--.

Signed and Sealed this

*Twenty-ninth* Day of *July 1980*

[SEAL]

*Attest:*

SIDNEY A. DIAMOND

*Attesting Officer*

*Commissioner of Patents and Trademarks*